US011595767B1

(12) United States Patent
Rüfenacht et al.

(10) Patent No.: US 11,595,767 B1
(45) Date of Patent: Feb. 28, 2023

(54) RECHARGEABLE HEARING DEVICES AND CHARGERS FOR USE WITH SAME

(71) Applicant: Sonova AG, Stäfa (CH)

(72) Inventors: Marius Rüfenacht, Volketswil (CH); Hans Wunderli, Zurich (CH); Markus Gaugler, Horgen (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/529,347

(22) Filed: Nov. 18, 2021

(51) Int. Cl.
*H04R 25/00* (2006.01)

(52) U.S. Cl.
CPC ..... *H04R 25/602* (2013.01); *H04R 25/556* (2013.01); *H04R 2225/021* (2013.01); *H04R 2225/31* (2013.01)

(58) Field of Classification Search
CPC ..... H04R 25/602; H04R 2225/31; H04R 2225/33
See application file for complete search history.

(56) References Cited

U.S. PATENT DOCUMENTS 9,967,644 B2 5/2018 Chawan et al.
10,212,506 B2 2/2019 Panecki et al.
2008/0136369 A1 6/2008 Klemenz et al.
2018/0332408 A1 11/2018 Frei et al.
2019/0173301 A1* 6/2019 Narayanasamy ..... H02J 7/0045
2020/0260176 A1 8/2020 Baltensperger et al.

FOREIGN PATENT DOCUMENTS

EP 3518560 B1 11/2020
WO WO 2015/105648 A1 7/2015

* cited by examiner

*Primary Examiner* — Suhan Ni
(74) *Attorney, Agent, or Firm* — Henricks Slavin LLP

(57) ABSTRACT

A system with a first hearing device including a rechargeable power source, a second hearing device including a rechargeable power source, and a hearing device charger including a charger housing, a power source, charge circuitry operably connected to the power source, a first charge location and a second charge location. The first hearing device, the second hearing device and the hearing device charger may be respectively configured such that the first hearing device will be magnetically attracted to the hearing device charger in response to the first hearing device being positioned at the first charge location, the first hearing device will be magnetically repelled by the hearing device charger in response to the first hearing device being positioned at the second charge location, the second hearing device will be magnetically attracted to the hearing device charger in response to the second hearing device being positioned at the second charge location, and the second hearing device will be magnetically repelled by the hearing device charger in response to the second hearing device being positioned at the first charge location.

17 Claims, 9 Drawing Sheets

RECHARGEABLE HEARING DEVICES AND CHARGERS FOR USE WITH SAME

BACKGROUND

1. Field

The present disclosure relates generally to hearing systems that include rechargeable hearing devices and a hearing device charger.

2. Description of the Related Art

A wide variety of hearing devices are available. Such devices include, but are not limited to, hearing aids and implantable cochlear stimulation (or "ICS") systems.

Hearing aids may include a microphone, sound processor circuitry, a speaker (sometimes referred to as a "receiver") and a rechargeable battery. Ambient sound pressure waves are picked up by the microphone and converted into electrical signals. The electrical signals, in turn, are processed by sound processor circuitry. The processed signals drive the speaker, which delivers amplified (or otherwise processed) sound pressure waves to the ear canal. Exemplary types of hearing aids include, but are not limited to, BTE hearing aids, receiver-in the-canal ("RIC") hearing aids, and in-the-canal ("ITC") hearing aids. Examples of commercially available hearing aids include, but are not limited to, the Phonak Bolero™ hearing aid and the Phonak Naida™ hearing aid.

ICS systems, on the other hand, directly excite the intact auditory nerve with controlled impulses of electrical current. Some ICS systems include an implantable device and an external sound processor, such as a BTE sound processor, with a microphone, sound processor circuitry, a transmitter and a rechargeable battery. Ambient sound pressure waves are picked up by the microphone and converted into electrical signals. The electrical signals, in turn, are processed by the sound processor circuitry, converted to a pulse sequence having varying pulse widths and/or amplitudes, and transmitted to an implanted receiver circuit. The implanted receiver circuit is connected to an implantable electrode array that has been inserted into the cochlea of the inner ear, and electrical stimulation current is applied to varying electrode combinations to create a perception of sound. One example of a commercially available ICS sound processor is the Advanced Bionics Naida™ sound processor.

In either case, patients are often provided with a hearing device for each ear and, in those instances where the left and right ears of a patient have different audiological requirements, the fitting process results in different hearing device programing for the left and right ears. In other words, there is often a left side hearing device (or "left hearing device") and a right side hearing device (or "right hearing device"), and it is important that patients wear their hearing devices on or in the ear to which the hearing device has been fitted (sometimes referred to herein as the "intended ear"). A charger that is capable of simultaneously charging both of the left and right hearing devices is also commonly provided.

The present inventors have determined that conventional hearing device systems that include left and right hearing devices and a charger are susceptible to improvement. For example, placing the left hearing device on the left side of the charger and the right hearing device on the right side of the charger is one way for users increase the likelihood that they will place the hearings devices on or in the intended ear.

Some conventional hearing systems include indicia on the hearings devices, such as colored dots, to identify differentiate between the left and right hearings devices and corresponding indicia on the charger to encourage users to place the left and right hearings devices on the intended sides of the charger. The present inventors have determined that reliance on such indicia is less than optimal. For example, the indicia occupies a very small portion of a very small device, which makes the indicia difficult to see, thereby limiting the effectiveness of the indicia.

SUMMARY

A system in accordance with at least one of the present inventions comprises a first hearing device including a rechargeable power source, a second hearing device including a rechargeable power source, and a hearing device charger including a charger housing, a power source, charge circuitry operably connected to the power source, a first charge location and a second charge location. The first hearing device, the second hearing device and the hearing device charger may be respectively configured such that the first hearing device will be magnetically attracted to the hearing device charger in response to the first hearing device being positioned at the first charge location, the first hearing device will be magnetically repelled by the hearing device charger in response to the first hearing device being positioned at the second charge location, the second hearing device will be magnetically attracted to the hearing device charger in response to the second hearing device being positioned at the second charge location, and the second hearing device will be magnetically repelled by the hearing device charger in response to the second hearing device being positioned at the first charge location.

A method for use with a hearing device charger having a left charge location and a right charge location in accordance with at least one of the present inventions comprises magnetically attracting a left hearing device to the left charge location when the left hearing device is at the left charge location, and magnetically repelling the left hearing device when the left hearing device is at the right charge location.

There are a variety of advantages associated with such systems and methods. By way of example, but not limitation, the present systems and methods limit placement of a left hearing device to the left charge location on a charger and limit placement of a right hearing device to the right charge location of the charger, thereby increasing the likelihood that users will place their hearings devices on or in the intended ear in a manner that is more effective than the use of small visible indicia.

The above described and many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

DETAILED DESCRIPTION OF THE EXEMPLARY EMBODIMENTS

The following is a detailed description of the best presently known modes of carrying out the inventions. This description is not to be taken in a limiting sense, but is made merely for the purpose of illustrating the general principles of the inventions. The present inventions also have application in a wide variety of hearing devices that provide sound (i.e., either sound or a perception of sound) to the hearing impaired as well as others who require such hearing devices on a situational basis. Examples of such hearing devices include hearing aids, such as BTE hearing aids, RIC hearing aids, ITC hearing aids, and ICS systems. The present inventions are not, however, limited to hearing aids and ICS systems, and may be employed in combination with other hearing devices that currently exist, or are yet to be developed.

It should also be noted that if and when used herein, the term "lateral" refers to the direction and parts of hearing devices which face away from the tympanic membrane, the term "medial" refers to the direction and parts of hearing devices which face toward the tympanic membrane, the term "superior" refers to the direction and parts of hearing devices which face the top of the head, the term "inferior" refers to the direction and parts of hearing devices which face the feet, the term "anterior" refers to the direction and parts of hearing devices which face the front of the body, and the "posterior" refers to the direction and parts of hearing devices which face the rear of the body.

Figure 1:
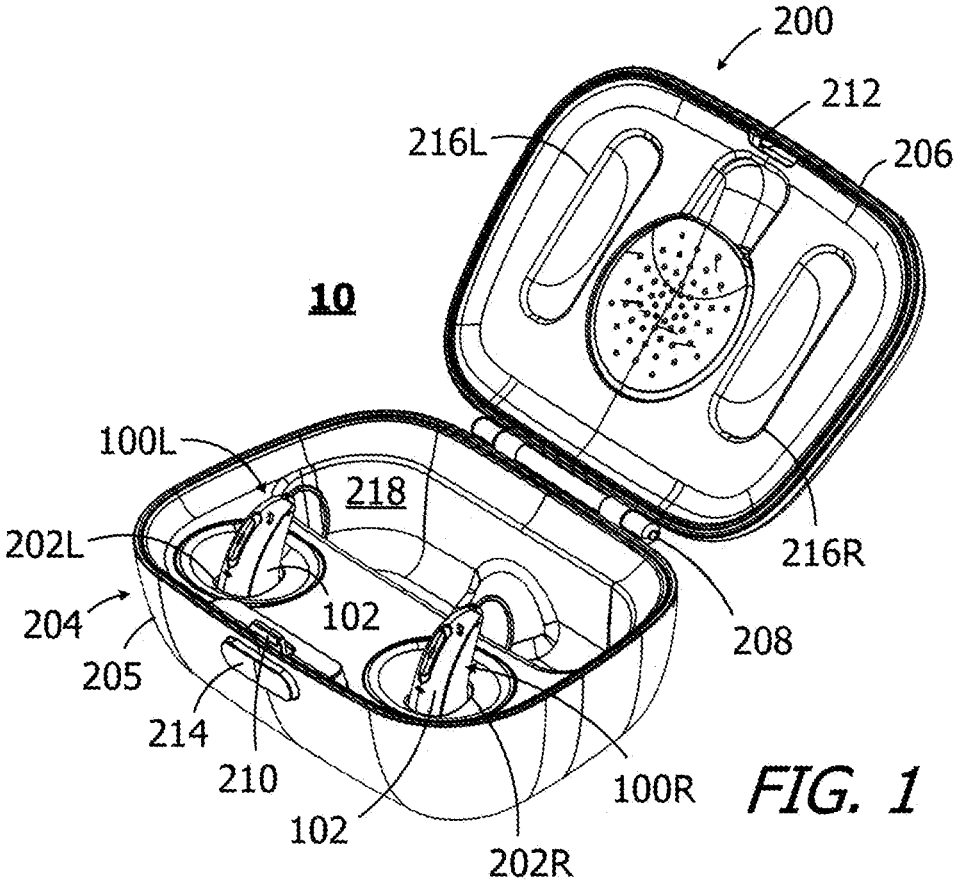
FIG. 1 is a perspective view of a hearing system including a hearing device charger and left and right hearing devices in accordance with one embodiment of a present invention.
Figure 2:
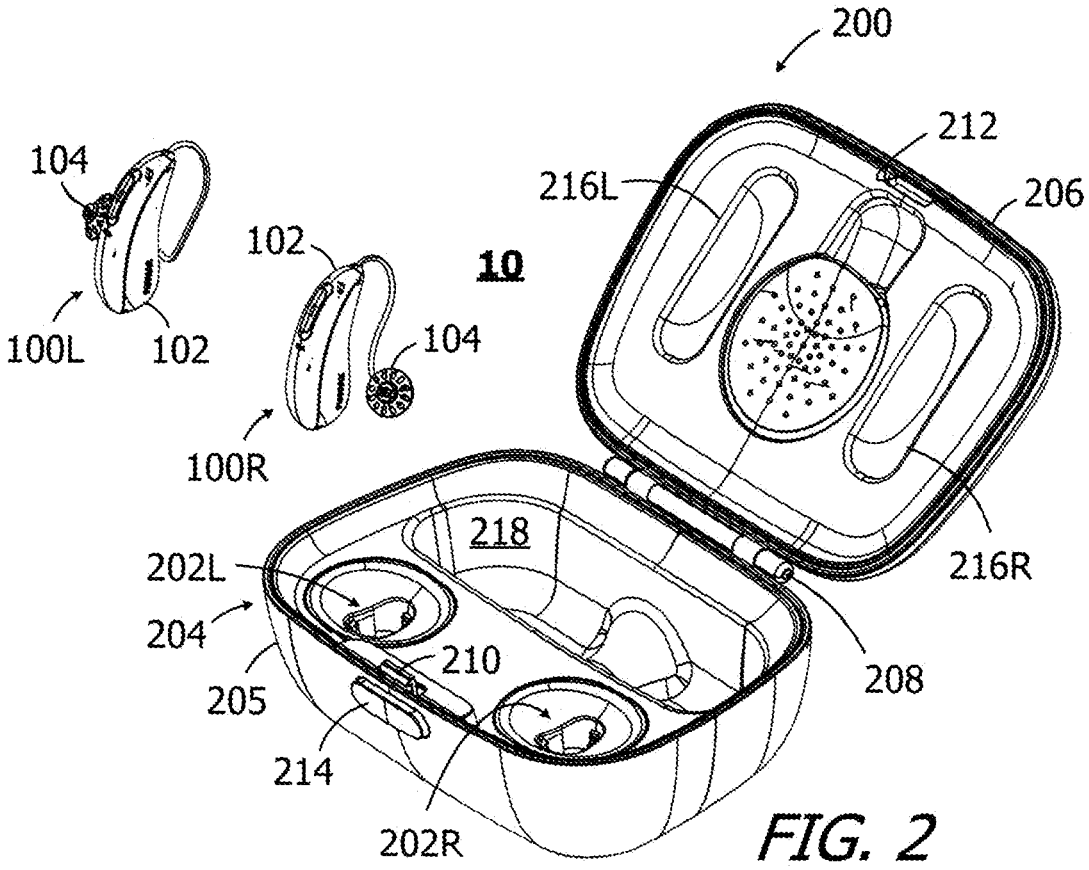
FIG. 2 is an exploded perspective view of the hearing system illustrated in FIG. 1.

One example of a hearing system is the hearing aid system generally represented by reference numeral 10 in FIGS. 1 and 2. The exemplary hearing aid system 10 includes left and right hearing aids 100L and 100R (collectively "hearing aids 100") and a hearing aid charger 200. The left and right hearing aids 100L and 100R in the illustrated implementation are identical but for the programming that takes place during the filling process and different magnetic interactions with the hearing aid charger 200. In particular, and as discussed in greater detail below, the charger 200 may include a left charge location 202L and a right charge location 202R that is located to the right of the left charge location from the perspective of a person facing the front of the charger where the button 214 (discussed below) is located. The left hearing aid 100L will be magnetically attracted to the hearing aid charger 200 when positioned at the left charge location 202L and will be magnetically repelled by the hearing aid charger when positioned at the right charge location 202R. The right hearing aid 100L will be magnetically attracted to the hearing aid charger 200 when positioned at the right charge location 202R and will be magnetically repelled by the hearing aid charger when positioned at the left charge location 202L.

Users of the present system 10 will advantageously be forced to place to the left hearing aid 100L at the left charge location 202L and right hearing aid 100R at the right charge location 202R. The aforementioned dots or other left/right identification indicia may be omitted from the hearing aids 100 and the charger 200 (as shown), so that the magnetic relationship between the hearing aids and the charger is the sole indicator as to which hearing aid is the left hearing aid and which hearing aid is the right hearing aid before, during and after fitting. In other implementations, the hearing aids and charger may include indicia, such as a blue dot on the left hearing aid and a red dot on the right hearing aid to represent "left" and "right" and corresponding blue and red dots at the left and right charge locations on the charger, to provide additional guidance.

Figure 3:
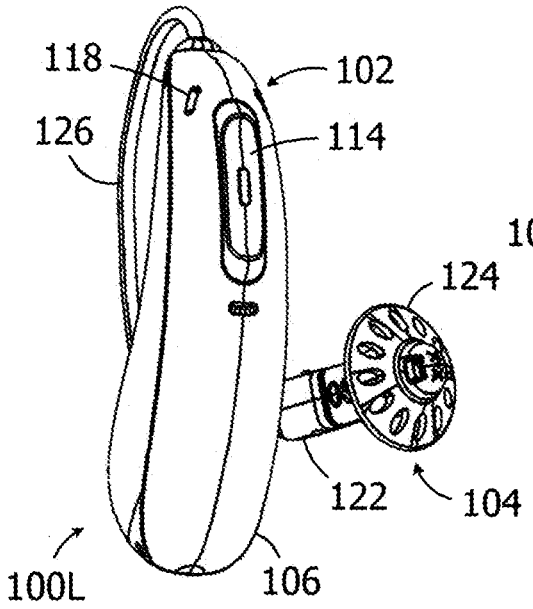
FIG. 3 is a front view of one of the hearing devices illustrated in FIG. 1.
Figure 4:
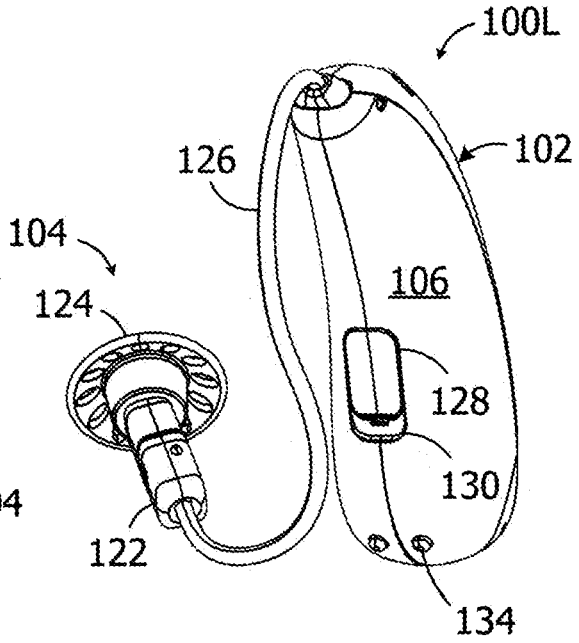
FIG. 4 is a rear view of one of the hearing devices illustrated in FIG. 1.
Figure 5:
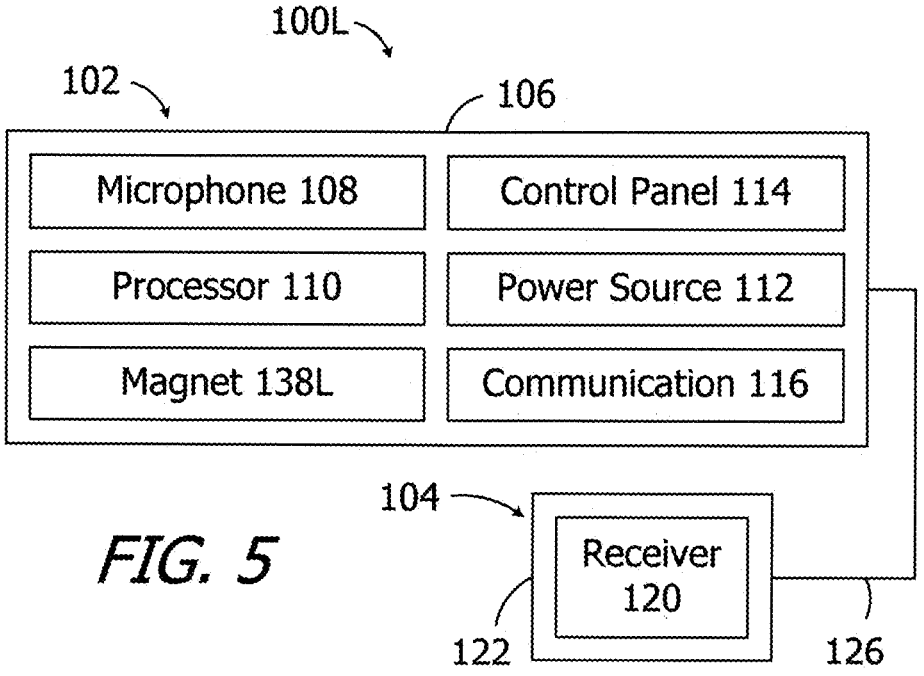
FIG. 5 is a functional block diagram of one of the hearing devices illustrated in FIG. 1.
Figure 6:
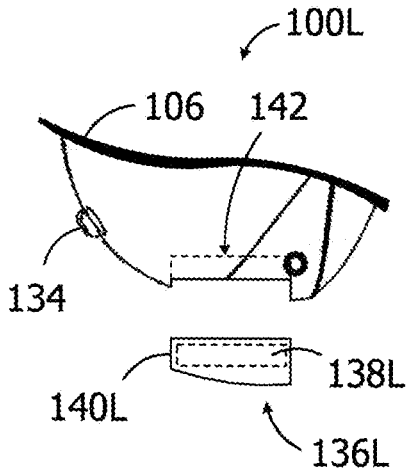
FIG. 6 is an exploded side view of a portion of one of the hearing devices illustrated in FIG. 1.
Figure 7:
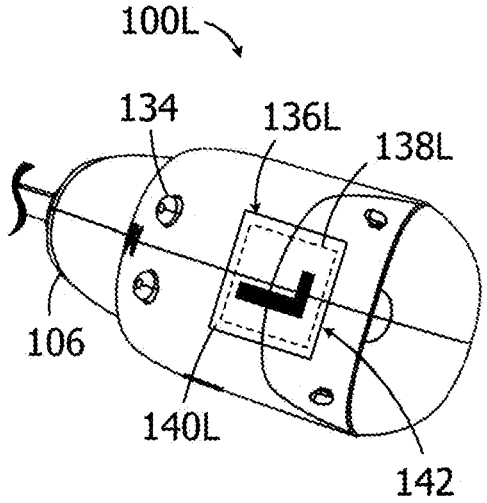
FIG. 7 is a bottom view of a portion of one of the hearing devices illustrated in FIG. 1.
Figure 8:
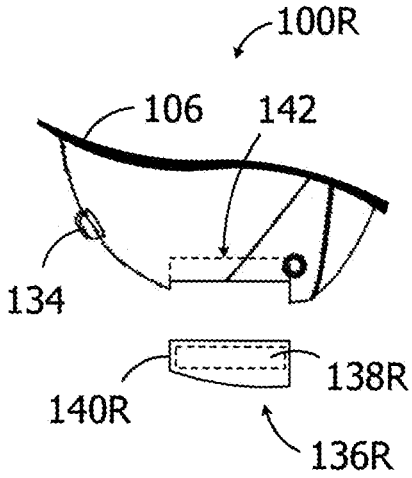
FIG. 8 is an exploded side view of a portion of one of the hearing devices illustrated in FIG. 1.
Figure 9:
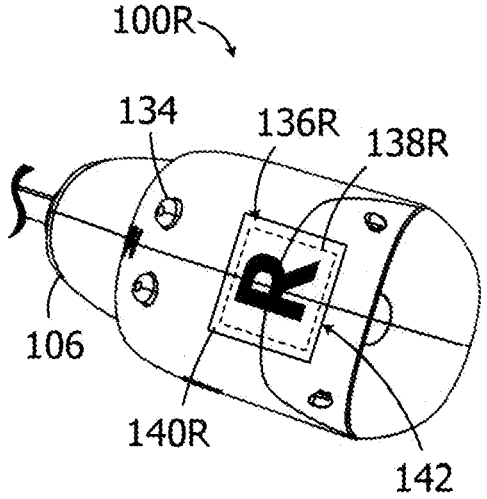
FIG. 9 is a bottom view of a portion of one of the hearing devices illustrated in FIG. 1.

As illustrated for example in FIGS. 3-5, the exemplary hearing aids 100 (represented by hearing aid 100L) include a BTE component 102 that receives sound (including sound signals from another device) and an ITE component 104 that delivers sound to ear canal. The exemplary BTE component 102 may have a housing 106, one or more microphones 108, a processor 110 that may be used for sound processing, a rechargeable battery or other rechargeable power source 112, and a control panel 114. A communication apparatus 116, such as an antenna and a receiver/transmitter, may be provided to allow the BTE component to communicate with external devices such as mobile phones and computers. The housing 106 may include microphone apertures 118. The exemplary ITE component 104 includes a receiver 120, which is located within a receiver housing 122, and a soft earpiece assembly 124 that is mounted on the medial end of the receiver housing 122 to center the receiver relative to the ear canal. A multi-wire cable 126 electrically connects the BTE component 102 to the ITE component 104. In some instances, such as when desired by the recipient or required by regulation, a colored insert 128 that is indicative of "left" or "right" may be positioned in a recess 130. The insert 128 and recess 130 may be eliminated in other implementations.

The rechargeable power source 112 may be operably connected to the hearing aid charger 200 in any suitable manner. In the illustrated embodiment, the hearing aids 100 have electrical contacts 134 on the exterior of the BTE component housing 106 that make physical and electrical contact with corresponding contacts (discussed below) on the charger 200. In other embodiments, power may be inductively transferred to from the charger to the power source 112 by way of antenna coils (not shown) within the charger and hearing aid.

The exemplary hearing aids 100 are also each provided with a magnet that interacts with magnets in the charger 200 in the manner described below with reference to FIGS. 15-20. The hearing aid magnets may be located at any suitable location within the housing 106 or on the exterior of the housing 106. The magnets within each hearing aid 100 will interact differently with the magnets in the charger 200. For example, and as alluded to above, the configuration and orientation the magnets may be such that the left hearing aid 100L will be magnetically attracted at the left charge location 202L and magnetically repelled at the right charge location 202R, while the right hearing aid 100L will be magnetically attracted at the right charge location 202R and will be magnetically repelled at the left charge location 202L. Put another way, the magnets perform the function of preventing the left hearing aid 100L from being charged at the right charge location 202R and preventing the right hearing aid 100R from being charged at the left charge location 202L.

Figure 10:
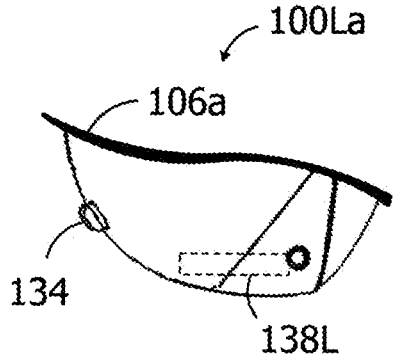
FIG. 10 is a side view of a hearing device in accordance with one embodiment of a present invention.
Figure 11:
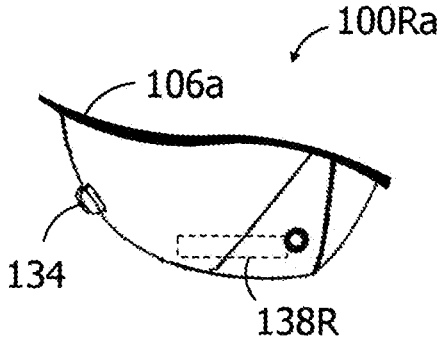
FIG. 11 is a side view of a hearing device in accordance with one embodiment of a present invention.

In one exemplary implementation, and referring to FIGS. 6-9, the hearing aids 100L and 100R may have respective magnet inserts 136L and 136R that include respectively include magnets 138L and 138R within over-molded carriers 140L and 140R. The magnet inserts 136L and 136R may be permanently or removably secured to receptacles 142 on the housings 106, and this may be done at the time of fitting or prior to fitting. The exemplary magnet inserts 136L and 136R may be identical to one but for the orientation of the magnets 138L and 138R with the carriers 140L and 140R and, accordingly, within the hearing aids 100L and 100R. In particular, magnets 138L and 138R may be oriented such that, for example, south pole of the magnet 138L faces the inferior end of the hearing aid 100L and the north pole of the magnet 138R faces the inferior end of the hearing aid 100R, as is discussed below with reference to FIGS. 15 and 16. In some instances, the magnet inserts 136L and 136R may include identifying indicia, such as "L" and "R," that can be used when the associated hearing aids are configured as "left" and "right." The identifying indicia may be located on the magnet inserts 136L and 136R such that it will be visible after the inserts are secured to the receptacles 142, or located on the magnet inserts such that it will not be visible. Turning to FIGS. 10 and 11, the exemplary hearing aids 100La and 100Ra are essentially identical hearing aids 100L and 100R and similar elements are represented by similar reference numerals. Here, however, the housings 106*a* do not include inserts and receptacles and the magnets 138L and 138R are permanently located within the housings. The hearing aids 100La and 100Ra may be manufactured with internal magnets that have different N-S orientations. The hearing aids 100La and 100Ra may, on the other hand, be manufactured with internal magnets that have the same N-S orientations and the N-S orientations of some of the magnets may be reversed at a later time (e.g., during fitting) by exposing those hearing aids to a strong magnetic field.

Referring again to FIGS. 1 and 2, the exemplary charger 200 includes a base 204, with a housing 205 in which various components are located and on which various components are supported, and a cover 206 that may be pivotably connected to the base with a hinge 208. The cover 206, which is shown in an open state in FIGS. 1 and 2, may be maintained in a closed state with a spring-biased latch 210 on the base 204 and an indentation 212 on the cover 206. A release button 214 may be located on the front of the base 204. The cover 206 may be provided with indentations 216L and 216R to accommodate the hearing aids 100L and 100R in those instances where the hearing aids project upwardly beyond the top of the base 204. A receptacle 218 is provided in the base 204 for the ITE components 104.

Figure 12:
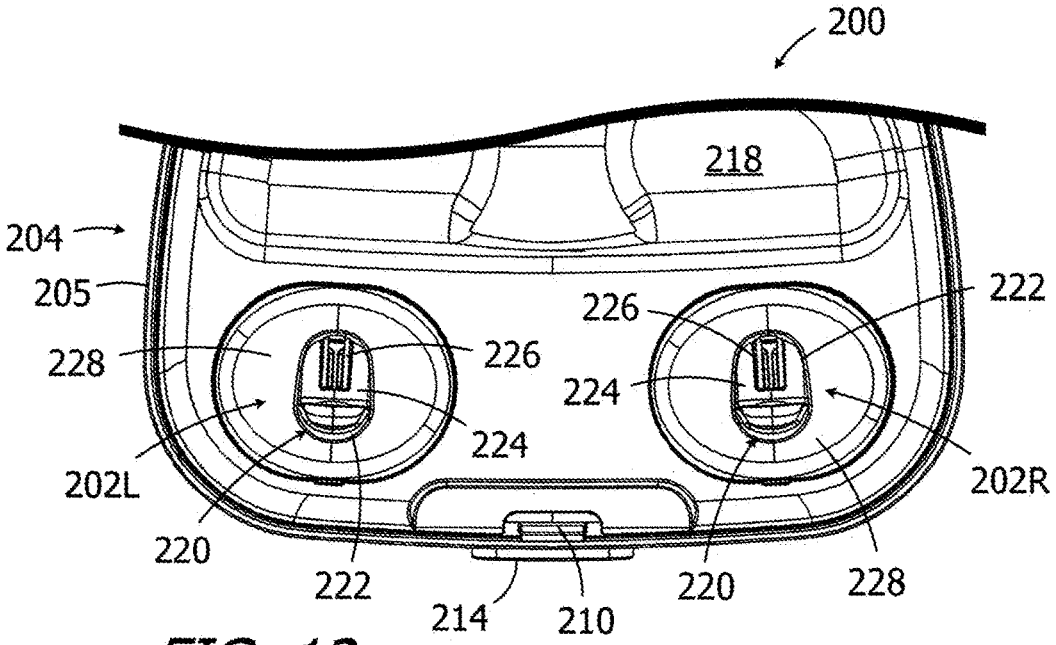
FIG. 12 is a top view of a portion of the hearing device charger illustrated in FIG. 1.
Figure 13:
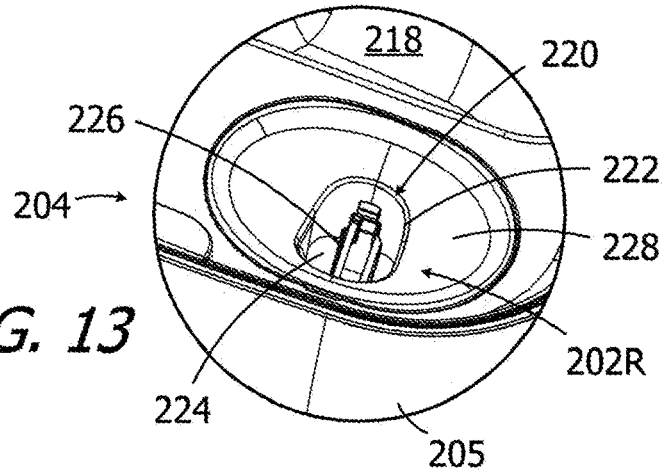
FIG. 13 is a perspective view of a portion of the hearing device charger illustrated in FIG. 1.
Figure 14:
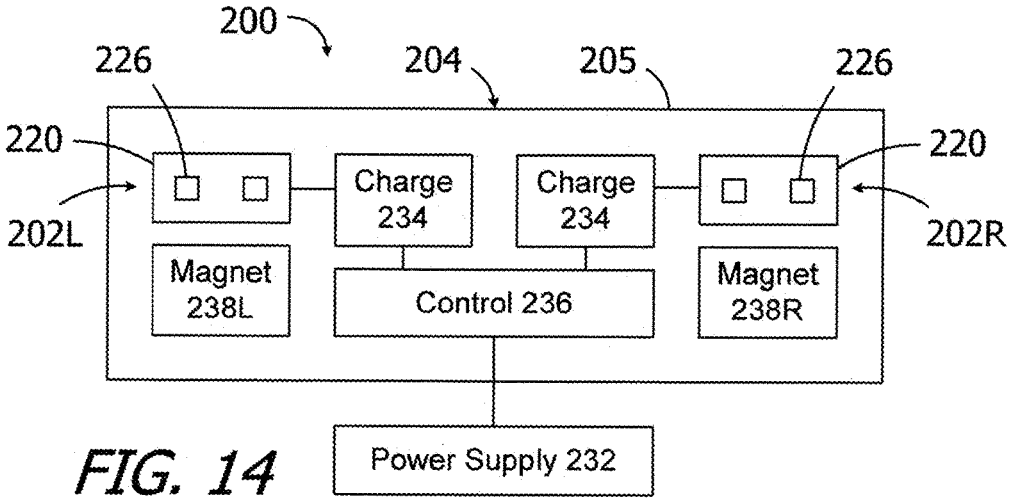
FIG. 14 is a functional block diagram of the hearing device charger illustrated in FIG. 1.

Turning to FIGS. 12-14, the left and right charge locations 202L and 202R of the exemplary charger 200 are identical but for different magnetic interactions with the hearing aids 100L and 100R and, in some instances, indicia (not shown) that represents "left" and "right." For example, the charge locations 202L and 202R each include a receptacles 220, with a side walls 222 and a bottom wall 224, and a pair of contacts 226. A sloping surface 228 may also be provided to facilitate placement of the hearing aid BTE components 102 into the receptacles 220. The size and shape of the receptacles 220 and locations of the contacts 226 correspond to the size and shape of the hearing aid BTE components 102 and locations of the contacts 134. As such, when the hearing aids 100L and 100R are properly positioned at the left and right charge locations 202L and 202R, the hearing aid contacts 134 will be in contact with the charge location contacts 226.

With respect to the recharging of the hearing aids 100, the exemplary charger 200 includes a power supply 232 (e.g., an external USB power supply) that may be connected to a connector (not shown) on the back of the base 204 as well as charging circuits 234 that are connected to the contacts 226. A power pack (not shown) that connects to the bottom of the base 204 may also be provided. Operation of the charger is controlled by control circuity 236.

Referring to FIG. 14, he exemplary charger 200 also includes left and right magnets 238L and 238R that are associated with the left and right charge locations 202L and 202R. For example, the magnets 238L and 238R may be located under the receptacle bottom walls 224 or adjacent to the receptacle side walls 222. The exemplary magnets 238L and 238R may be identical to one but for their orientation relative to the left and right charge locations 202L and 202R and the receptacles 220. In particular, magnets 238L and 238R may be oriented such that, for example, north pole of the magnet 238L faces the bottom wall 224 of the receptacle 220 at left charge location 202L and the south pole of the magnet 238R faces the bottom wall of the receptacle at right charge location 202R. The magnets 238L and 238R may be permanent magnets (as shown) or electromagnet as discussed below with reference to FIG. 23.

Figure 15:
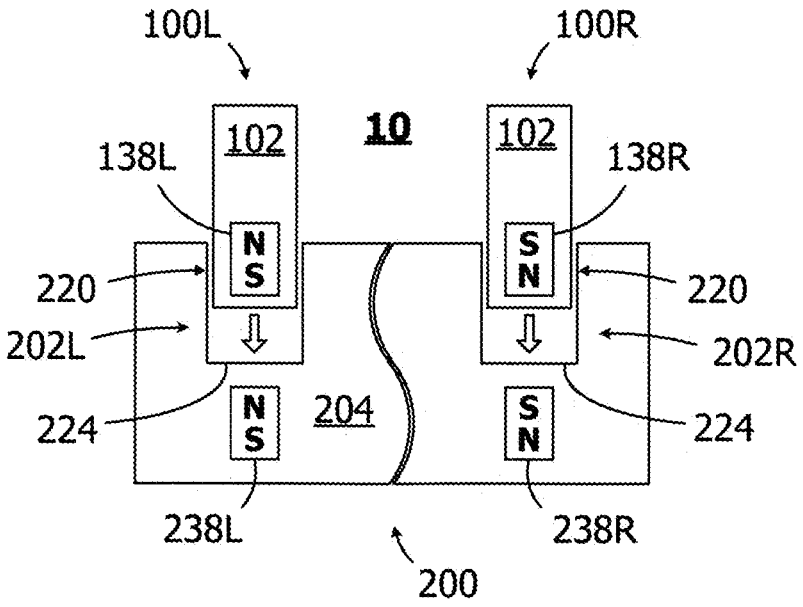
FIGS. 15 and 16 are diagrammatic views of the hearing system illustrated in FIG. 1.
Figure 16:
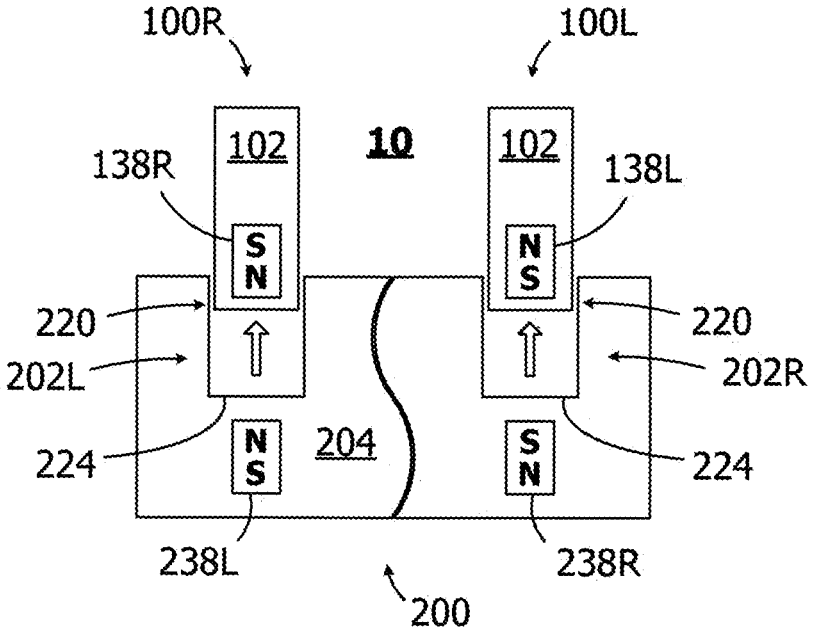

Turning to FIG. 15, when the left hearing aid 100L is placed into the receptacle 220 at the left charge location 202L, the magnets 138L and 238L will be magnetically attracted to one another. The left hearing aid 100L will, accordingly, be magnetically attracted to the hearing aid charger 200. Similarly, when the right hearing aid 100R is placed into the receptacle 220 at the right charge location 202R, the magnets 138R and 238R will be magnetically attracted to one another and, accordingly, the right hearing aid 100R will be magnetically attracted to the charger 200. Conversely, when the right hearing aid 100R is placed into the receptacle 220 at the left charge location 202L, the magnets 138R and 238L will be magnetically repelled by one another, as shown in FIG. 16, and the right hearing aid 100R will be magnetically repelled by the charger 200, thereby preventing charging of the right hearing aid at the left charge location. Similarly, when the left hearing aid 100L is placed into the receptacle 220 at the right charge location 202L, the magnets 138L and 238R will be magnetically repelled by one another and the left hearing aid 100L will be magnetically repelled by the charger 200, thereby preventing charging of the left hearing aid at the right charge location. Put another way, the present hearing aids 100 and charger 200 are configured in such a manner that the user must place the left hearing aid 100L at the left charge location 202L and must place the right hearing aid 100R at the right charge location 202R. The present hearing aids 100 and charger 200 also provide tactile feedback concerning left/right identities of the hearing aids 100 with the attraction and repulsion forces.

Figure 17:
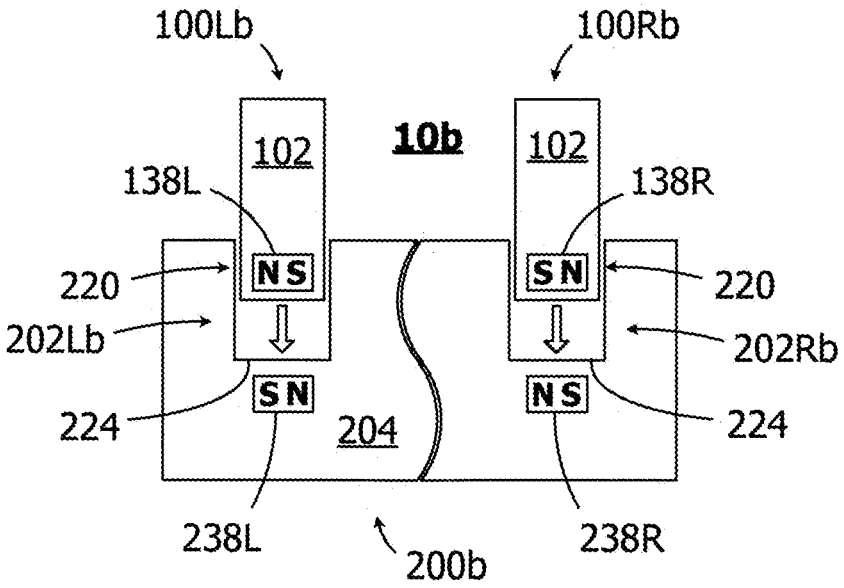
FIGS. 17 and 18 are diagrammatic views of a hearing system in accordance with one embodiment of a present invention.
Figure 18:
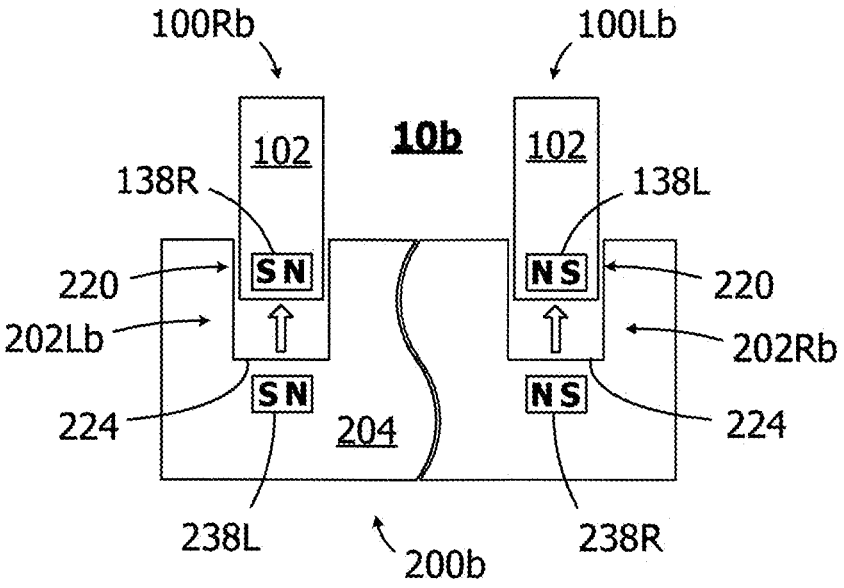

It should be noted here that the present hearing aids (or other hearing devices) and chargers are not limited to the magnet orientations illustrated in FIGS. 15 and 16. To that end, the exemplary hearing aids 100Lb and 100Rb and charger 200*b* in the exemplary hearing aid system 10*b* illustrated in FIGS. 17 and 18 are essentially identical to the hearings aids and charger illustrated in FIGS. 1-9 and 12-16 and similar elements are represented by similar reference numerals. For example, the hearing aids 100Lb and 100Rb include respective magnets 138L and 138R, while the left and right charge locations 202L and 202R have receptacles 220 and magnets 238L and 238R. Here, however, the magnets are offset by 90 degrees (as compared to the system 10). The N-S directions of the magnets 138L and 138R of the hearings aids 100Lb and 100Rb extend in the medial-lateral direction, and the N-S directions of the magnets 238L and 238R of the charger 200*b* are parallel to the bottom walls 224 of the receptacles 220.

Referring more specifically to FIG. 17, when the left hearing aid 100Lb is placed into the receptacle 220 at the left charge location 202Lb, the magnets 138L and 238L will be magnetically attracted to one another and the left hearing aid 100Lb will be magnetically attracted to the charger 200*b*. Similarly, when the right hearing aid 100Rb is placed into the receptacle 220 at the right charge location 202Rb, the magnets 138R and 238R will be magnetically attracted to one another and the right hearing aid 100Rb will be magnetically attracted to the charger 200*b*. Conversely, when the right hearing aid 100Rb is placed into the receptacle 220 at the left charge location 202Lb, the magnets 138R and 238L will be magnetically repelled by one another, as shown in FIG. 18, and the right hearing aid 100Rb will be magnetically repelled by the charger 200*b*. Similarly, when the left hearing aid 100Lb is placed into the receptacle 220 at the right charge location 202Lb, the magnets 138L and 238R will be magnetically repelled by one another and the left hearing aid 100Lb will be magnetically repelled by the charger 200*b*.

Figure 19:
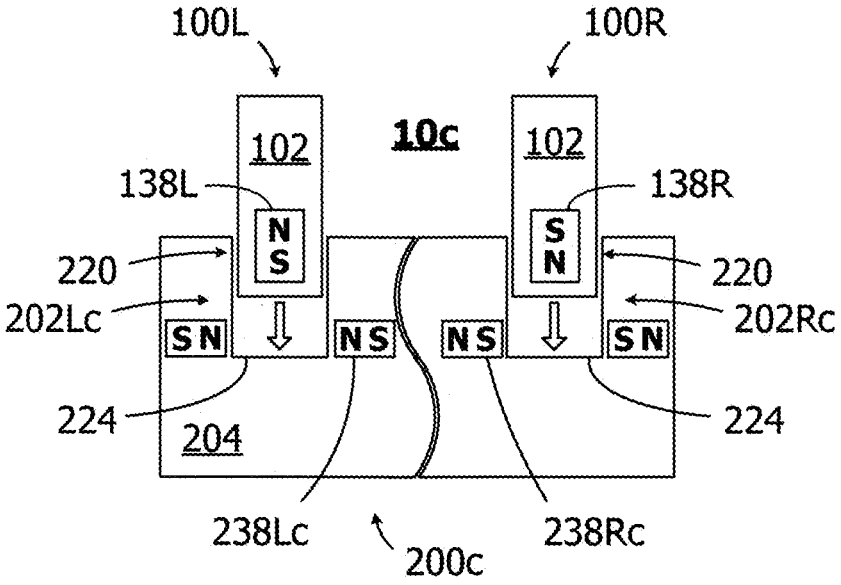
FIGS. 19 and 20 are diagrammatic views of a hearing system in accordance with one embodiment of a present invention.
Figure 20:
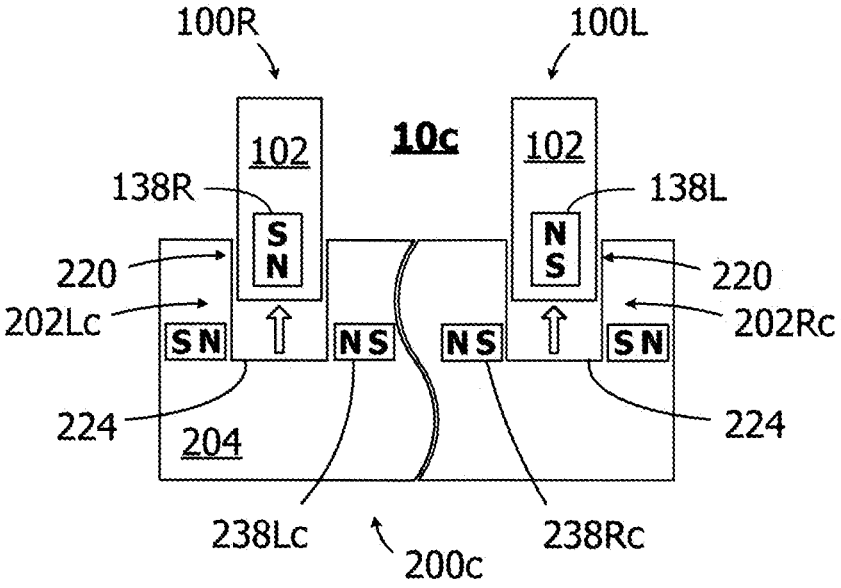

Another exemplary hearing aid system is generally represented by reference numeral 10*c* in FIGS. 19 and 20, and is essentially identical to the hearing aid system 10 illustrated in FIGS. 1-9 and 12-16. Similar elements are represented by similar reference numerals. For example, the system 10*c* includes hearing aids 100L and 100R with respective magnets 138L and 138R, while the charger 200*c* includes left and right charge locations 202Lc and 202Rc with receptacles 220. Here, however, the left charge location 202Lc includes a pair of magnets 238Lc and the right charge location 202Rc includes a pair of magnets 238Rc. The magnets 238Lc and 238Rc, which may be smaller than the magnets 238L and 238R (as shown) or the same size or larger, are located adjacent to the receptacles side walls 222.

Referring more specifically to FIG. 19, when the left hearing aid 100L is placed into the receptacle 220 at the left charge location 202Lc, the magnets 238Lc will be magnetically attracted to the magnet 138L and the left hearing aid 100L will be magnetically attracted to the charger 200*c*. Similarly, when the right hearing aid 100R is placed into the receptacle 220 at the right charge location 202Rc, the magnets 238Rc will be magnetically attracted to the magnet 138R and the right hearing aid 100R will be magnetically attracted to the charger 200*c*. Conversely, when the right hearing aid 100R is placed into the receptacle 220 at the left charge location 202Lc, the magnet 138R will be magnetically repelled by the magnets 238Lc, as shown in FIG. 20, and the right hearing aid 100R will be magnetically repelled by the charger 200. Similarly, when the left hearing aid 100L is placed into the receptacle 220 at the right charge location 202Lc, the magnet 138L will be magnetically repelled by the magnets 238Rc and the left hearing aid 100L will be magnetically repelled by the charger 200*c*.

Figure 21:
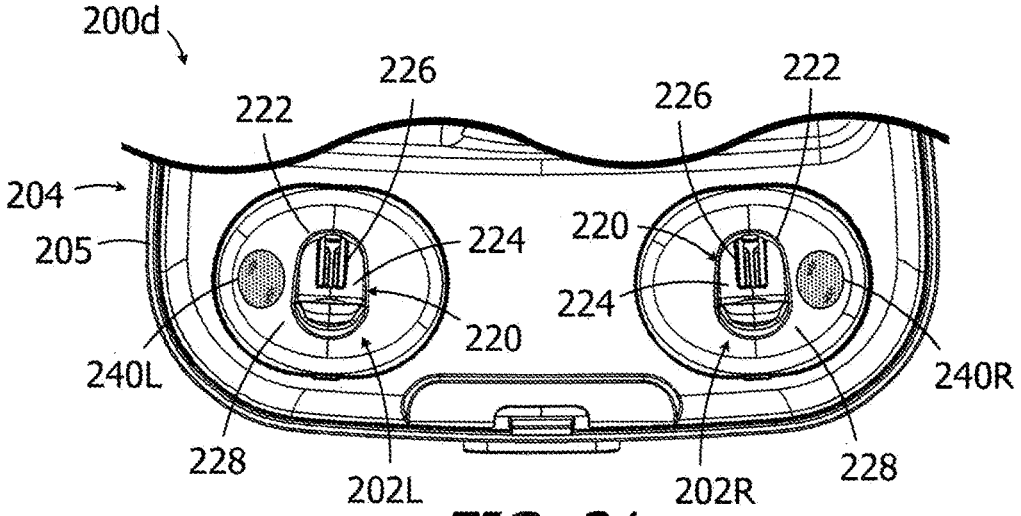
FIG. 21 is a top view of a portion of a hearing device charger in accordance with one embodiment of a present invention.
Figure 22:
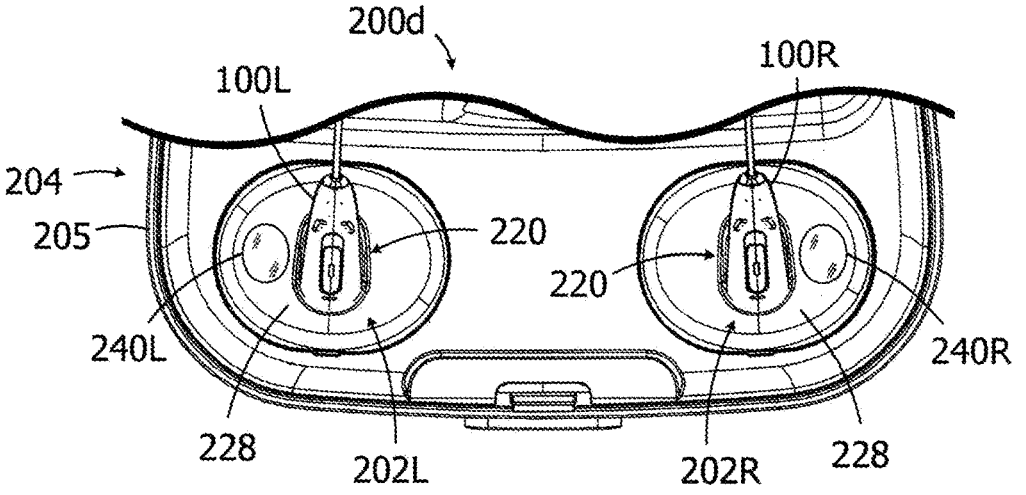
FIG. 22 is a top view of a portion of a hearing device system including the hearing device charger illustrated in FIG. 21.

Turning to FIGS. 21 and 22, exemplary charger 200*d* is essentially identical to charger 200 and similar elements are represented by similar reference numerals. In addition to those aspects described above, the charger 200*d* is provided with a light source, such as an LED, at each of the left and right charge locations 202L and 202R. The light sources 240L and 240R may be separately controlled by the controller 236 so that one light source may be in an "off" state while the other light source is in an "on" state. The light source 240L is maintained in the "off" state (FIG. 21) and is switched to the "on" state when the left hearing aid 100L is placed into the receptacle 220 at the left charge location 202L (FIG. 22). The light source 240R is maintained in the "off" state (FIG. 21) and is switched to the "on" state when the right hearing aid 100R is placed into the receptacle 220 at the right charge location 202R (FIG. 22). The presence of a hearing aid may be sensed by sensing a change in resistance across the contacts 226, or through the use of a light gate or other suitable instrumentality. The light sources 240L and 240R will return to the "off" state when the hearing aids 100L and 100R are removed from the charge locations 202L and 202R.

Figure 23:
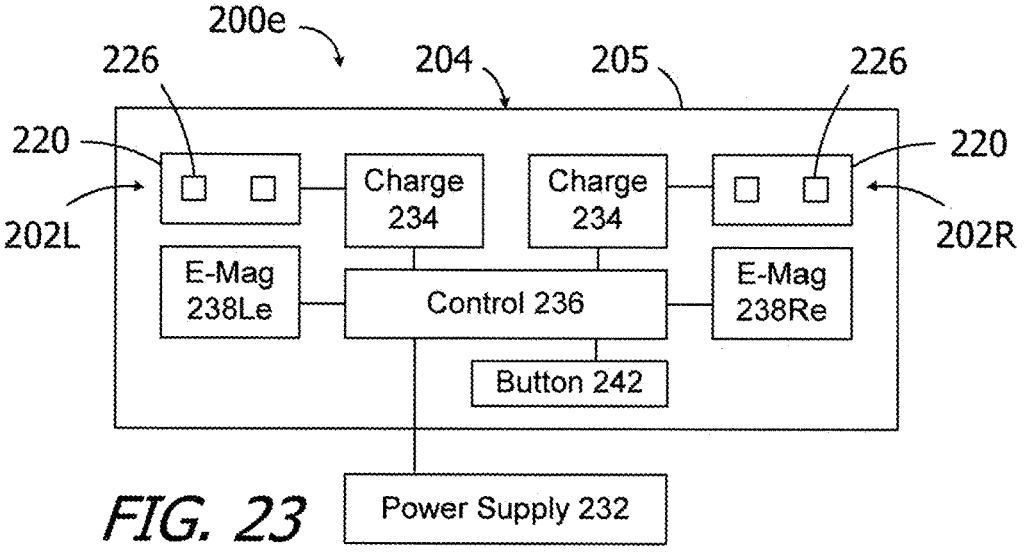
FIG. 23 is a functional block diagram of a hearing device charger in accordance with one embodiment of a present invention.

Another exemplary charger is generally represented by reference numeral 200*e* in FIG. 23. Charger 200*e* is essentially identical to charger 200 and similar elements are represented by similar reference numerals. Here, however, the charger 200*e* includes left and right electromagnets 238Le and 238Re in place of permanent magnets 238L and 238R, and the controller 236 is capable of controlling the electromagnets to release the associated hearing aids from the charger. In the illustrated implementation, the default polar orientation of the left and right electromagnets 238Le and 238Re may be the same as that of the magnets 238L and 238R illustrated in FIG. 15. The controller 236 will reverse the polarity electromagnets 238Le and 238Re, or simply turn the magnets "off," in response to a user command from, for example, a button 242 on the base 204. The polarity may remain reversed, or the electromagnets 238Le and 238Re may remain "off," for a predetermined time (e.g., 30 seconds) after the button is pressed or, in other instances, until the button is released.

Figure 24:
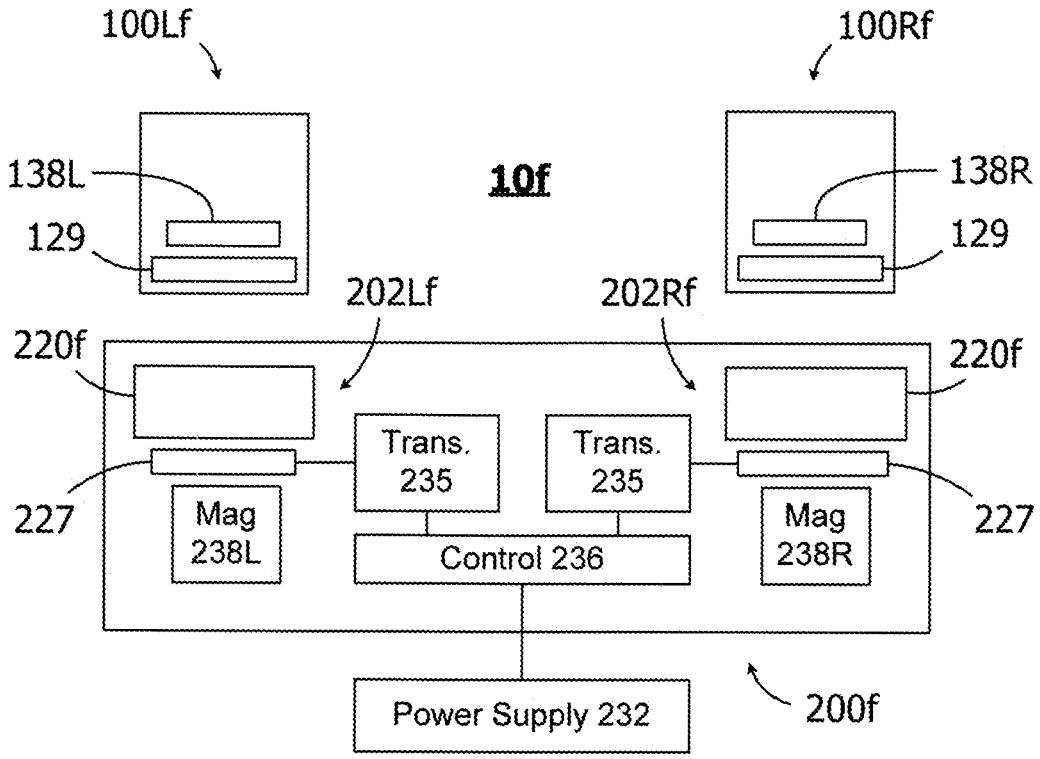
FIG. 24 is a functional block diagram of a hearing device system in accordance with one embodiment of a present invention.

The exemplary system 10*f* in FIG. 24 includes left and right ITE hearing aids 100Lf and 100*f* (collectively "hearing aids 100*f*") and a hearing aid charger 200*f*. The left and right ITE hearing aids 100Lf and 100Rf in the illustrated implementation are identical but for the programming that takes place during the filling process and different magnetic interactions with the hearing aid charger 200*f* that are similar to the interactions described in detail above with reference to system 10. To that end, the ITE hearing aids 100Lf and 100Rf respectively include magnets 138L and 138R as well as conventional components such as a microphone, sound processor circuitry, a receiver and a rechargeable battery or other power supply. The hearing aids 100*f* also include antenna coils 129 that are used to receive power from the charger 200*f*. The charger 200*f* includes left and right charge locations 202Lf and 202Rf, antenna coils 227 that transmit power to the hearing aid antennas 129 via inductive coupling, receptacles 220*f* that are configured to receive the hearing aids 100*f*, transmitter circuits (or "charge circuits") 235 that drive the antennas 227, and magnets 238L and 238R. In addition to selectively attracting the hearings aids 100*f* to the charger 200*f*, or repelling the hearings aids, the magnets 138L/238L and 138R/238 align the antennas 129 and 227.

Although the inventions disclosed herein have been described in terms of the preferred embodiments above, numerous modifications and/or additions to the above-described preferred embodiments would be readily apparent to one skilled in the art. By way of example, but not limitation, the inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. A system, comprising:

a first hearing device including a rechargeable power source;

a second hearing device including a rechargeable power source; and a hearing device charger including a charger housing, a power source, charge circuitry operably connected to the power source, a first charge location and a second charge location;

wherein the first hearing device, the second hearing device and the hearing device charger are respectively configured such that the first hearing device will be magnetically attracted to the hearing device charger in response to the first hearing device being positioned at the first charge location, the first hearing device will be magnetically repelled by the hearing device charger in response to the first hearing device being positioned at the second charge location, the second hearing device will be magnetically attracted to the hearing device charger in response to the second hearing device being positioned at the second charge location, and the second hearing device will be magnetically repelled by the hearing device charger in response to the second hearing device being positioned at the first charge location.

2. A system as claimed in claim 1, wherein the hearing device charger includes a first receptacle and a second receptacle;

the first charge location is located within the first receptacle; and the second charge location is located within the second receptacle.

3. A system as claimed in claim 1, wherein the hearing device charger includes a first set of charger electrical contacts operably connected to the charge circuitry and associated with the first charge location;

the hearing device charger includes a second set of charger electrical contacts operably connected to the charge circuitry and associated with the second charge location;

the first hearing device includes hearing device electrical contacts operably connected to the rechargeable power source; and the second hearing device includes hearing device electrical contacts operably connected to the rechargeable power source.

4. A system as claimed in claim 1, wherein the hearing device charger includes a first charger coil operably connected to the charge circuitry and associated with the first charge location;

the hearing device charger includes a second charger coil operably connected to the charge circuitry and associated with the second charge location;

the first hearing device includes a coil operably connected to the rechargeable power source; and the second hearing device includes a coil operably connected to the rechargeable power source.

5. A system as claimed in claim 1, wherein the first hearing device comprises a BTE hearing device; and the second hearing device comprises a BTE hearing device.

6. A system as claimed in claim 1, wherein the first hearing device comprises an ITE hearing device; and the second hearing device comprises an ITE hearing device.

7. A system as claimed in claim 1, wherein the first hearing device includes a hearing device housing and a hearing device magnet that defines a north pole, a south pole and a first hearing device N-S orientation relative to the hearing device housing;

the second hearing device includes a hearing device housing and a hearing device magnet that defines a north pole, a south pole and a second hearing device N-S orientation relative to the hearing device housing that is different than the first hearing device N-S orientation;

the hearing device charger includes a first charger magnet at the first charge location that defines a north pole, a south pole and a first charger N-S orientation relative to the first charge location; and the hearing device charger includes a second charger magnet at the second charge location that defines a north pole, a south pole and a second charger N-S orientation relative to the second charge location that is different than the first charger N-S orientation.

8. A system as claimed in claim 1, wherein the first charger magnet comprises a first electromagnet; and the second charger magnet comprises a second electromagnet.

9. A system as claimed in claim 1, wherein the first charge location comprises a left charge location; and the second charge location comprises a right charge location.

10. A method for use with a hearing device charger having a left charge location and a right charge location, comprising:

magnetically attracting a left hearing device to the left charge location when the left hearing device is at the left charge location; and magnetically repelling the left hearing device when the left hearing device is at the right charge location.

11. A method as claimed in claim 10, further comprising:

charging the left hearing device at the left charge location.

12. A method as claimed in claim 10, wherein the left hearing device is magnetically attracted to the left charge location with magnets that are located within the left hearing device and the left charge location.

13. A method as claimed in claim 10, wherein the left hearing device is magnetically repelled at the right charge location with magnets that are located within the left hearing device and the right charge location.

14. A method as claimed in claim 10, further comprising:

magnetically attracting a right hearing device to the right charge location when the right hearing device is at the right charge location; and magnetically repelling the right hearing device when the right hearing device is at the left charge location.

15. A method as claimed in claim 14, further comprising:

charging the right hearing device at the right charge location.

16. A method as claimed in claim 14, wherein the right hearing device is magnetically attracted to the right charge location with magnets that are located within the right hearing device and the right charge location.

17. A method as claimed in claim 14, wherein the right hearing device is magnetically repelled at the left charge location with magnets that are located within the right hearing device and the left charge location.

* * * * *